US012403382B2

(12) United States Patent
Chiyoda

(10) Patent No.: US 12,403,382 B2
(45) Date of Patent: Sep. 2, 2025

(54) CATCHING PROTECTION ASSEMBLY AND METHOD

(71) Applicant: Roof and Solar Technologies, Inc., Poway, CA (US)

(72) Inventor: Takashi Chiyoda, Poway, CA (US)

(73) Assignee: Roof and Solar Technologies, Inc., Poway, CA (US)

( * ) Notice: Subject to any disclaimer, the term of this patent is extended or adjusted under 35 U.S.C. 154(b) by 43 days.

(21) Appl. No.: 18/216,899

(22) Filed: Jun. 30, 2023

(65) Prior Publication Data

US 2025/0001280 A1 Jan. 2, 2025

(51) Int. Cl.
*A63B 71/12* (2006.01)

(52) U.S. Cl.
CPC ..... *A63B 71/1225* (2013.01); *A63B 71/1216* (2013.01); *A63B 2071/125* (2013.01); *A63B 2071/1258* (2013.01); *A63B 2071/1283* (2013.01)

(58) Field of Classification Search
CPC ..... A63B 71/1225; A63B 71/1216; A63B 2071/125; A63B 2071/1258; A63B 2071/1283; A63B 71/08; A41D 3/06; A41D 3/04
See application file for complete search history.

(56) References Cited

U.S. PATENT DOCUMENTS 5,975,293 A 11/1999 Fowlder
6,938,761 B2 9/2005 Nish
7,255,658 B1 * 8/2007 VanKuiken ..... A63B 69/0075 473/456
7,341,314 B1 * 3/2008 Boyd ..... A47C 9/10 297/188.09
7,674,194 B2 3/2010 Lortscher
8,251,269 B2 8/2012 Winneur
9,072,382 B2 * 7/2015 Johansson ..... A47C 4/021
9,457,255 B1 10/2016 Fitzgerald
9,474,263 B2 * 10/2016 Roberts ..... A01K 97/05
9,993,085 B1 6/2018 Hernandez
D864,642 S 10/2019 Hotchkiss et al.
11,103,073 B1 8/2021 Hertlein
2008/0242452 A1 10/2008 Brennan
(Continued)

FOREIGN PATENT DOCUMENTS

JP 6854014 B2 4/2021

*Primary Examiner* — Khoa D Huynh
*Assistant Examiner* — Erick I Lopez
(74) *Attorney, Agent, or Firm* — Procopio, Cory, Hargreaves & Savitch LLP

(57) ABSTRACT

A catching protection assembly comprising a catching protection cover configured to be donned by a catcher to protect to protect at least the catcher's knees, shins, and toes during catching; a groin area protector operatively associated with the container to protect at least the catcher's groin area during catching; a combination container and seat configured to contain and transport at least the catching protection cover and the groin area protector in a transport configuration and support a catcher in a seat configuration, wherein, in the transport configuration, the container contains and transports at least the catching protection cover and the groin area protector, and in a seat configuration, the container supports a catcher seated thereon.

5 Claims, 2 Drawing Sheets

(56) References Cited

U.S. PATENT DOCUMENTS

| | | | | |
|---|---|---|---|---|
| 2009/0282609 | A1* | 11/2009 | Kotoske | A41D 13/0562 2/463 |
| 2014/0335977 | A1 | 11/2014 | Baranek | |
| 2016/0345742 | A1 | 12/2016 | Wade | |

* cited by examiner

CATCHING PROTECTION ASSEMBLY AND METHOD

FIELD OF THE INVENTION

The present invention relates protectors for catching pitched baseballs.

BACKGROUND OF THE INVENTION

In baseball/softball, it is common for a parent or coach to perform catching for practicing pitchers. The parent/coach would normally put on a catcher's normal protective gear, crouch into a catcher's position, and catch pitches from the practicing pitcher. However, putting on catcher's protective gear is time-consuming and often not necessary.

SUMMARY OF THE INVENTION

Accordingly, an aspect of the disclosure that eliminates the time-consuming need to put on a catcher's normal protective gear involves a catching protection assembly and method for parents/coaches that do catching for practicing pitchers. The catching protection assembly includes a catching protection kilt with pads to protect the toes, knees, and groin areas of the catcher. In an implementation of this aspect of the disclosure, a container such as a bucket is not only used to store and transport the catching protection, but also serves as a seat for the catcher to rest on while catching. A groin area protector is operatively associated with a top edge of the container to protect the groin area of the catcher while catching.

An additional aspect of the disclosure involves a catching protection assembly comprising a catching protection cover configured to be donned by a catcher to protect to protect at least the catcher's knees, shins, and toes during catching; a groin area protector operatively associated with the container to protect at least the catcher's groin area during catching; a combination container and seat configured to contain and transport at least the catching protection cover and the groin area protector in a transport configuration and support a catcher in a seat configuration, wherein, in the transport configuration, the container contains and transports at least the catching protection cover and the groin area protector, and in a seat configuration, the container supports a catcher seated thereon.

One or more implementations of the aspect of the disclosure described immediately above includes one or more of the following: the catching protection cover includes one or more of laterally spaced pairs of knee protectors, shin protectors, and toe protectors with a central protection section spanning a central lateral distance between the one or more of laterally spaced pairs of knee protectors, shin protectors, and toe protectors; the container includes a front and a top edge, and the groin area protector is operatively associated with the top edge and the front of the container to secure the groin area protector to the front of the container to protect the groin area of the catcher while catching; the groin area protector includes a tongue member and a pair of parallel retainer members spaced from the tongue member to form a container front receiver configures to slide over and receive the front of the container to secure the groin area protector to the container; the groin area protector includes container front receiver configured to slide over and receive the front of the container to secure the groin area protector to the container, and a groin protection member that extends forward and upward from the container front receiver and the front of the container to protect the groin area of the catcher while catching; the groin protection member includes a top and tapers in width progressing from a greater width at the container front receiver to a lesser width at the top of the groin protection member; and/or the container includes a reversible and combination lid and seat with one side having a rigid top surface and an opposite side having a cushion member.

A further aspect of the disclosure involve a method of using a catching protection assembly comprising a catching protection cover configured to be donned by a catcher to protect to protect at least the catcher's knees, shins, and toes during catching; a groin area protector operatively associated with the container to protect at least the catcher's groin area during catching; a combination container and seat configured to contain and transport at least the catching protection cover and the groin area protector in a transport configuration and support a catcher in a seat configuration, wherein, in the transport configuration, the container contains and transports at least the catching protection cover and the groin area protector, and in a seat configuration, the container supports a catcher seated thereon, the method comprising transporting at least the catching protection cover and the groin area protector in the container with the container in the transport configuration; receiving the catcher seated on the container with the container in the seat configuration; donning the catching protection cover so that the catcher's knees, shins, and toes are covered and protected during catching; operatively associating the groin area protector to container to protect at least the catcher's groin area during catching.

One or more implementations of the aspect of the disclosure described immediately above includes one or more of the following: the catching protection cover includes one or more of laterally spaced pairs of knee protectors, shin protectors, and toe protectors with a central protection section spanning a central lateral distance between the one or more of laterally spaced pairs of knee protectors, shin protectors, and toe protectors, and donning the catching protection cover includes donning the catching protection cover so that the central protection section spans the central lateral distance, and the catcher's knees, shins, and toes are covered and protected during catching; the container includes a front and a top edge, and the groin area protector is operatively associated with the top edge and the front of the container to secure the groin area protector to the front of the container to protect the groin area of the catcher while catching, and operatively associating the groin area protector includes operatively associating the groin area protector with the top edge and the front of the container to protect at least the catcher's groin area during catching; the groin area protector includes a container front receiver configured to slide over and receive the front of the container to secure the groin area protector to the container, and a groin protection member that extends forward and upward from the container front receiver and the front of the container to protect the groin area of the catcher while catching, and operatively associating the groin area protector includes receiving the container front receiver over the front of the container to secure the groin area protector to the container; and/or the container includes a reversible and combination lid and seat with one side having a rigid top surface and an opposite side having a cushion member, and transporting with the container includes transporting with the rigid top surface of the reversible and combination lid and seat face up, and receiving on the container includes receiving the catcher seated on the container with the cushion member face up.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
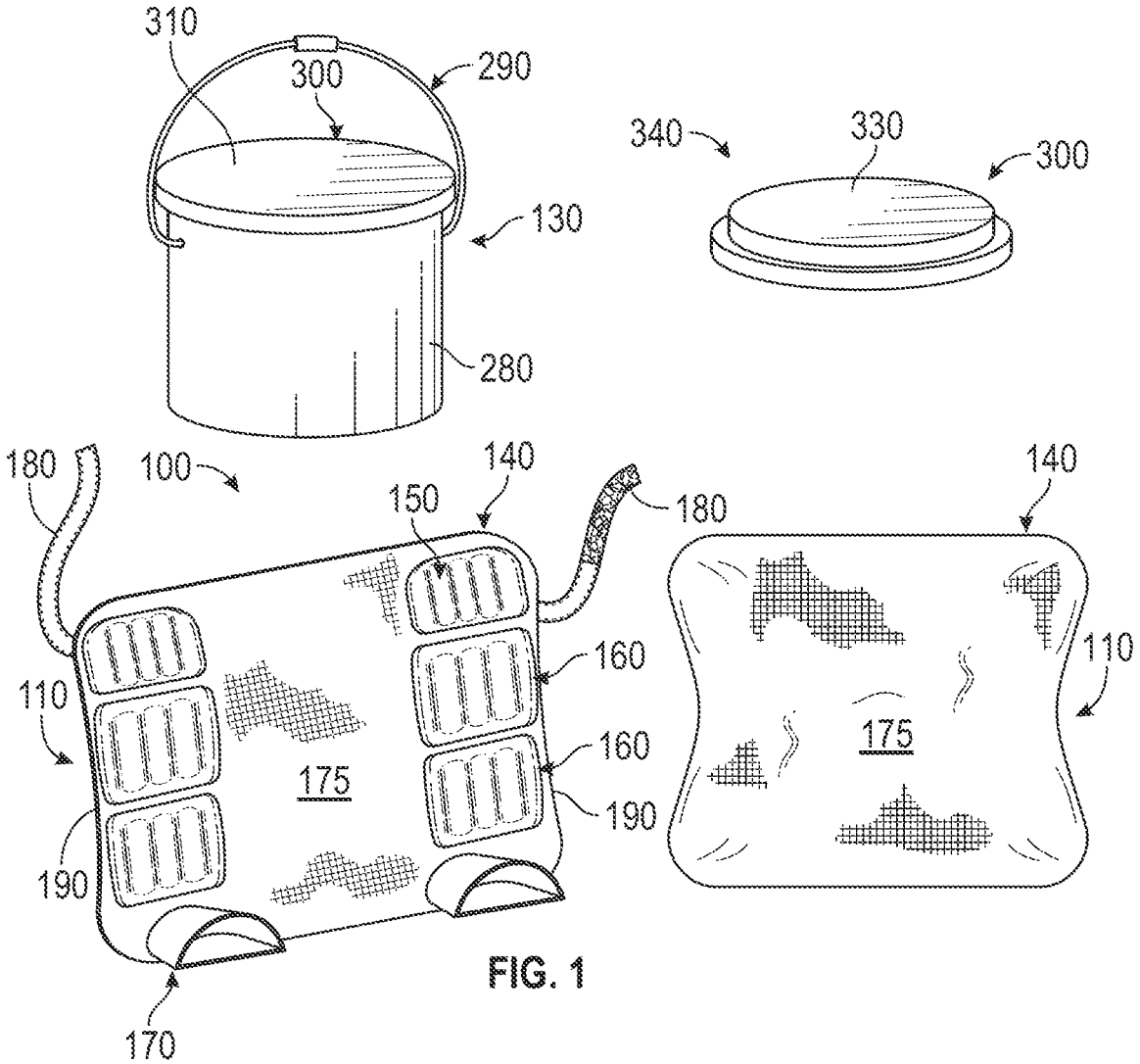
FIG. 1 is a perspective view of an embodiment of a catching protection assembly.
Figure 2:
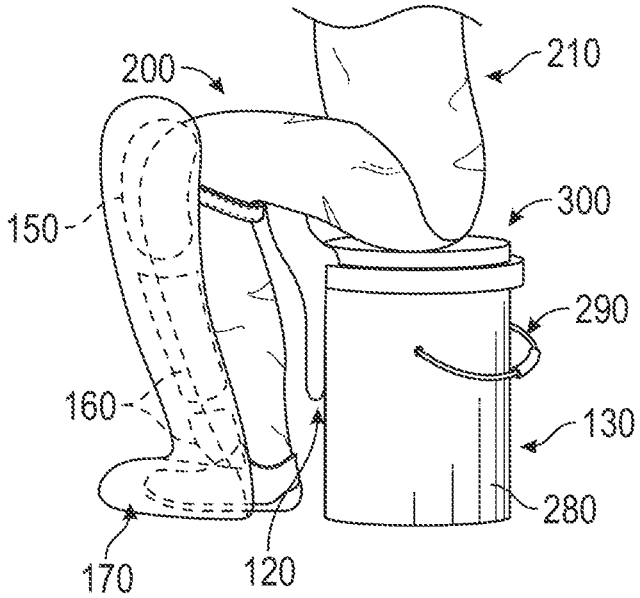
FIG. 2 is a perspective view of the catching protection assembly of FIG. 1 shown in use.

With reference to FIGS. 1-4, an embodiment of a catching protection assembly 100 and method of using the same for parents/coaches that do catching for practicing pitchers will be described. The catching protection assembly ("assembly") 100 eliminates the time-consuming need to put on a catcher's normal protective gear.

In one or more embodiments, the catching protection assembly 100 includes one or more of a catching protection cover or kilt 110, a groin area protector 120, and a container (e.g., bucket) 130.

The catching protection cover 110 includes a protective shield 140 with one or more of spaced pairs of knee protectors (e.g., pads) 150, shin protectors (e.g., pads) 160, and toe protectors 170. A central protective section 175 spans a central lateral distance between the laterally disposed/spaced knee protectors 150, shin protectors 160, and toe protectors 170. One or more straps 180 are attached along opposite sides 190 of the protective shield 140 and include fastener(s) (e.g., hook and loop fasteners) to secure the catching protection cover 110 around/behind legs 200 of a catcher 210.

Figure 3:
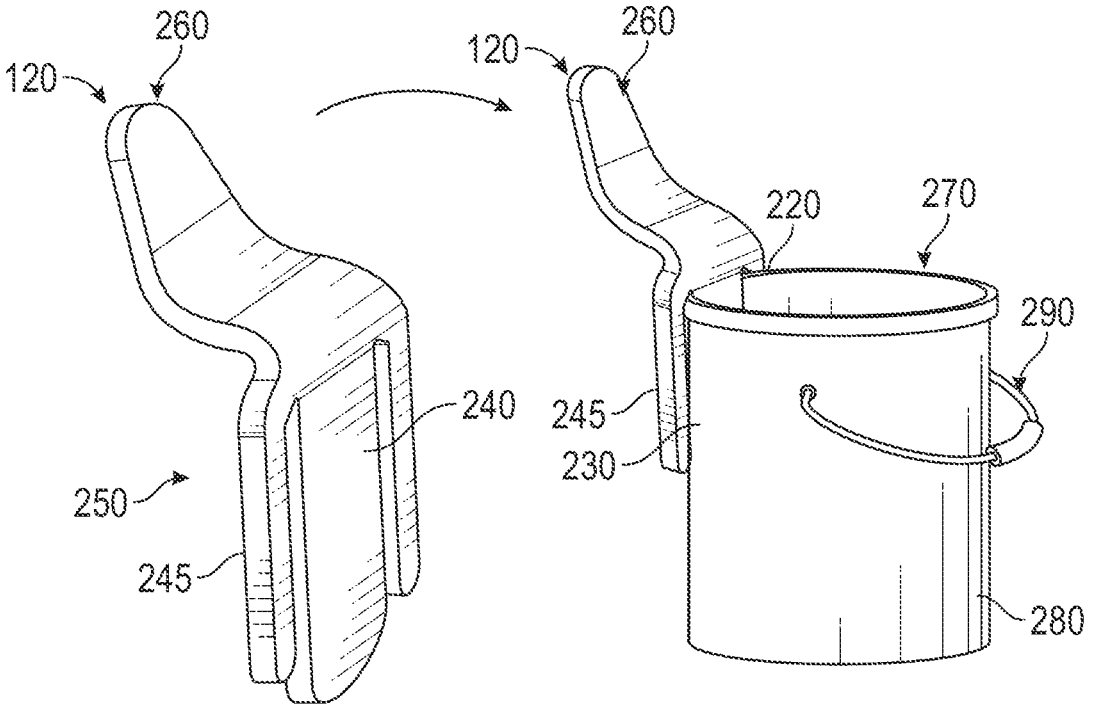
FIG. 3 is a perspective view of a groin area protector of the catching protection assembly of FIG. 1 shown applied to an edge of a container of the catching protection assembly.
Figure 4:
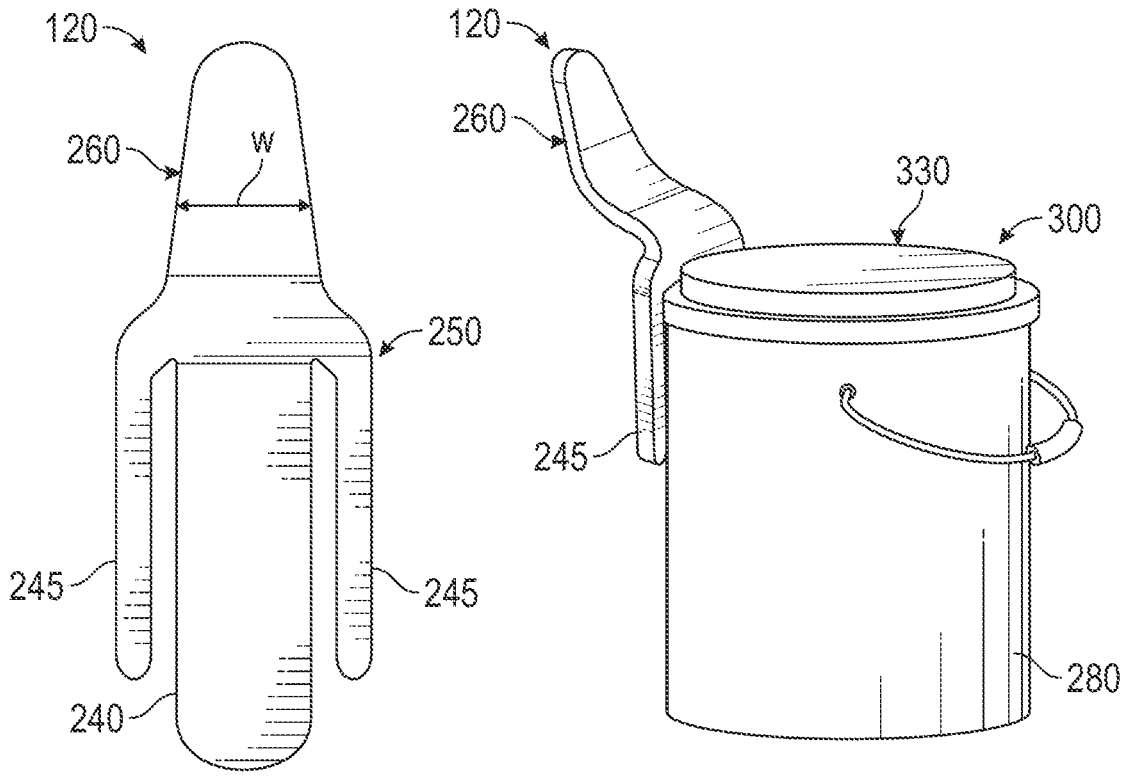
FIG. 4 is a perspective view of the groin area protector shown applied to the edge of a container of the catching protection assembly similar to FIG. 3 and shows a combination lid and seat of the of the catching protection assembly shown applied to a top of the container.

With reference to FIGS. 3 and 4, the groin area protector 120 is operatively associated with a top edge 220 of the container 130 to secure the groin area protector 120 to a front 230 of the container 130 to protect the groin area of the catcher 210 while catching. The groin area protector 120 includes a tongue member 240 spaced from a pair of parallel retainer members 245 that form a container front receiver 250 that slides over and receives the front 230 of the container 130 to secure the groin area protector 120 to the container 130. A groin protection member 260 extends forward and upward from the container front receiver 250 and the front 230 of the container 130 to protect the groin area of the catcher 210 while catching. The groin protection member 260 tapers in width W progressing from a greater width at the container front receiver 250 to a lesser width at a top 270 of the groin protection member 260.

The container 130 includes a cylindrical container body 280, a carrying handle 290 pivotally coupled to the cylindrical container body 280, and a reversible and combination lid and seat 300 with a rigid top surface 310 on one side 320 and a disc-shaped cushion member 330 on an opposite side 340.

A method of using the catching protection assembly 100 by parents/coaches during catching for practicing pitchers will be described. The method comprises transporting at least the catching protection cover 110 and the groin area protector 120 in the container 130 with the container 130 in a transport configuration where the reversible and combination lid and seat 300 is on the top 270 of the container with the rigid top surface 310 of the side 320 face up. The container 130 receives the catcher seated on the container 130 with the container 130 in the seat configuration where the reversible and combination lid and seat 300 is on the top 270 of the container with the disc-shaped cushion member 330 of the opposite side 340 face up. The catching protection cover 110 is donned so that the catcher's knees, shins, and toes are covered and protected during catching. The groin area protector 120 is operatively associated with/to container 130 to protect at least the catcher's groin area during catching.

In one or more implementations of the above method of using the catching protection assembly 100, the catching protection cover 110 includes one or more of the laterally spaced pairs of knee protectors 150, shin protectors 160, and toe protectors 170 with the central protection section 175 spanning the central lateral distance between the one or more of the laterally spaced pairs of knee protectors 150, shin protectors 160, and toe protectors 170, and donning the catching protection cover 110 includes donning the catching protection cover 110 so that the central protection section 175 spans the central lateral distance, and the catcher's knees, shins, and toes are covered and protected during catching; the groin area protector 120 is operatively associated with the top edge 220 and the front 230 of the container 130 to secure the groin area protector 120 to the front of the container 130 to protect the groin area of the catcher while catching, and operatively associating the groin area protector 120 includes operatively associating the groin area protector 120 with the top edge 220 and the front 230 of the container 130 to protect at least the catcher's groin area during catching; operatively associating the groin area protector 120 includes receiving the container front receiver 250 over the front 230 of the container 130 to secure the groin area protector 120 to the container 130; and/or the transporting with the container 130 includes transporting with the rigid top surface 130 of the reversible and combination lid and seat 300 face up, and receiving on the container 130 includes receiving the catcher seated on the container 130 with the cushion member 330 face up.

Advantages of the catching protection assembly 100 include eliminating the time-consuming need to put on a catcher's normal protective gear when catching for practicing pitchers. The catching protection cover 110 protects the toes, knees, and groin areas of the catcher and the central protective section 175 protects these areas of the catcher and the back of the catcher's legs from balls rebounding off the front 230 of the container 130. The container 130 not only serves to store and transport at least the catching protective gear (and other gear (e.g., catcher's mit, balls), but also serves as a seat for the catcher to rest on while catching. The groin area protector 120 quickly and easily attaches to and is removed from the front 230 of the container 130 to protect the groin area of the catcher while catching.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A method of using a catching protection assembly, the catching protection assembly comprising a catching protection cover configured to be donned by a catcher configured to protect at least a catcher's knees, shins, and toes during catching; a groin area protector operatively associated with a container configured to protect at least a catcher's groin area during catching; the combination container and seat configured to contain and transport at least the catching protection cover and the groin area protector in a transport configuration and support the catcher in a seat configuration, wherein in the transport configuration, the container contains and transports at least the catching protection cover and the groin area protector, in the seat configuration, the container configured to support the catcher seated thereon, the method comprising:

transporting at least the catching protection cover and the groin area protector in the container with the container in the transport configuration;

receiving the catcher seated on the container with the container in the seat configuration;

donning the catching protection cover so that the catcher's knees, shins, and toes are covered and protected during catching;

operatively associating the groin area protector to the container configured to protect at least the catcher's groin area during catching.

2. A method of using the catching protection assembly of claim 1, wherein the catching protection cover includes one or more of laterally spaced pairs of knee protectors, shin protectors, and toe protectors with a central protection section spanning a central lateral distance between the one or more of laterally spaced pairs of knee protectors, shin protectors, and toe protectors, and donning the catching protection cover includes donning the catching protection cover so that the central protection section spans the central lateral distance, and the catcher's knees, shins, and toes are configured to be covered and protected during catching.

3. A method of using the catching protection assembly of claim 1, wherein the container includes a front and a top edge, and the groin area protector is operatively associated with the top edge and the front of the container to secure the groin area protector to the front of the container configured to protect the groin area of the catcher while catching, and operatively associating the groin area protector includes operatively associating the groin area protector with the top edge and the front of the container configured to protect at least the catcher's groin area during catching.

4. A method of using the catching protection assembly of claim 3, wherein the groin area protector includes a container front receiver configured to slide over and receive the front of the container to secure the groin area protector to the container, and a groin protection member that extends forward and upward from the container front receiver and the front of the container configured to protect the groin area of the catcher while catching, and operatively associating the groin area protector includes receiving the container front receiver over the front of the container to secure the groin area protector to the container.

5. A method of using the catching protection assembly of claim 1, wherein the container includes a reversible and combination lid and seat with one side having a rigid top surface and an opposite side having a cushion member, and transporting with the container includes transporting with the rigid top surface of the reversible and combination lid and seat face up, and receiving on the container includes receiving the catcher seated on the container with the cushion member face up.

* * * * *